US011975418B2

(12) United States Patent
Chang

(10) Patent No.: US 11,975,418 B2
(45) Date of Patent: May 7, 2024

(54) BELT SANDER ASSEMBLY

(71) Applicant: Chin-Chin Chang, Taichung (TW)

(72) Inventor: Chin-Chin Chang, Taichung (TW)

( * ) Notice: Subject to any disclaimer, the term of this patent is extended or adjusted under 35 U.S.C. 154(b) by 704 days.

(21) Appl. No.: 17/116,334

(22) Filed: Dec. 9, 2020

(65) Prior Publication Data

US 2022/0176510 A1 Jun. 9, 2022

(51) Int. Cl.
*B24B 21/10* (2006.01)
*B24B 21/20* (2006.01)

(52) U.S. Cl.
CPC ..... *B24B 21/10* (2013.01); *B24B 21/20* (2013.01)

(58) Field of Classification Search
CPC ..... B24B 21/00; B24B 21/10; B24B 21/20; B24B 21/22; B24B 23/06; B24B 41/02; B24B 41/007; B24B 47/12; B24B 47/04; B24B 55/08; B24B 55/107; B23Q 1/4828; A47B 13/003; A47B 13/021; A47B 91/022; A47B 2013/022; B25H 1/06; B25H 1/02
USPC ..... 451/121, 159, 168, 296, 304, 355, 451, 451/453, 456, 513
See application file for complete search history.

(56) References Cited

U.S. PATENT DOCUMENTS 2,926,465 A * 3/1960 Sommers ..... B24B 21/18 451/304
5,916,014 A * 6/1999 Schroeder ..... B23Q 1/4828 451/157
8,186,282 B1 * 5/2012 Sinchok ..... A47B 13/021 108/147.12
8,602,798 B2 * 12/2013 Downing ..... H01R 4/46 248/65
10,675,749 B2 * 6/2020 Reinhart ..... B25H 1/14
2005/0066862 A1 * 3/2005 Choi ..... A47B 3/06 108/155
2018/0001466 A1 * 1/2018 Brunner ..... A47B 3/12
2019/0344397 A1 * 11/2019 Chang ..... B24B 21/22

* cited by examiner

*Primary Examiner* — Lee D Wilson
*Assistant Examiner* — Robert F Neibaur

(57) ABSTRACT

A base assembly includes a first horizontal brace, a second horizontal brace, a first horizontal interconnection interconnecting front ends of the first and second horizontal braces, a second horizontal interconnection interconnecting rear ends of the first and second horizontal braces, and first, second, third and fourth vertical posts each releasably secured to the underside of the worktable and the rear ends of the first and second horizontal braces; a control switch secured to the front ends of the first and second horizontal braces, and the first interconnection; and a detachable worktable including first and second sliding rods, an opening, first and second bifurcations, a housing; a chute; first and second bossed holes, two opposite third bossed holes, two opposite fourth bossed holes, first and second C-shaped clamps, a transverse second threaded hole, and screws.

1 Claim, 15 Drawing Sheets

BELT SANDER ASSEMBLY

BACKGROUND OF THE INVENTION

1. Field of the Invention

The invention relates to belt sanders and more particularly to an upward and downward motion mechanism for a belt sander.

2. Description of Related Art

A conventional motion mechanism for a belt sander including a continuous loop of sandpaper mounted on two end drums and comprises an electric motor, a pivotal member, a link, and a reduction gear assembly. After activating the electric motor, the end drums may move laterally due to operative cooperation of the motor shaft, the pivotal member, the link and the reduction gear assembly. As a result, the continuous loop of sandpaper may move laterally.

However, the conventional motion mechanism for a belt sander is disadvantageous because the movement of the belt sander is not smooth, its operation is not reliable, and the mechanism is complicated.

Thus, the need for improvement still exists.

SUMMARY OF THE INVENTION

It is therefore one object of the invention to provide a belt sander comprising a base assembly including a first horizontal brace, a second horizontal brace, a first horizontal interconnection interconnecting front ends of the first and second horizontal braces, a second horizontal interconnection interconnecting rear ends of the first and second horizontal braces, and first, second, third and fourth vertical posts each releasably secured to the underside of the worktable and the rear ends of the first and second horizontal braces; a control switch secured to the front ends of the first and second horizontal braces, and the first interconnection; and a detachable worktable including first and second sliding rods, an opening with the belt sander upward and downward moveably disposed therethrough, first and second bifurcations both on the underside, a housing mounted to the underside with a portion of the opening disposed thereabove; a chute disposed under both one end drum and the opening; a first bossed hole on the underside of the worktable with an upper end of the first sliding rod disposed through; a second bossed hole on the underside of the worktable with an upper end of the second sliding rod disposed through, two opposite third bossed holes on the underside of the worktable with the first bossed hole disposed therebetween, two opposite fourth bossed holes on the underside of the worktable with the second bossed hole disposed therebetween, a first C-shaped clamp with the first sliding rod passing through and having two opposite, longitudinal first threaded holes, a transverse second threaded hole, two first screws driven through the first threaded holes into the third bossed holes to secure the first C-shaped clamp to the underside of the worktable, and a second screw driven through the second threaded hole to adjustably secure the first C-shaped clamp to the first sliding rod, and a second C-shaped clamp with the second sliding rod passing through and having two opposite, longitudinal first threaded holes, a transverse second threaded hole, two first screws driven through the first threaded holes into the fourth bossed holes to secure the second C-shaped clamp to the underside of the worktable, and a second screw driven through the second threaded hole to adjustably secure the second C-shaped clamp to the second sliding rod.

The above and other objects, features and advantages of the invention will become apparent from the following detailed description taken with the accompanying drawings.

DETAILED DESCRIPTION OF THE INVENTION

Figure 1:
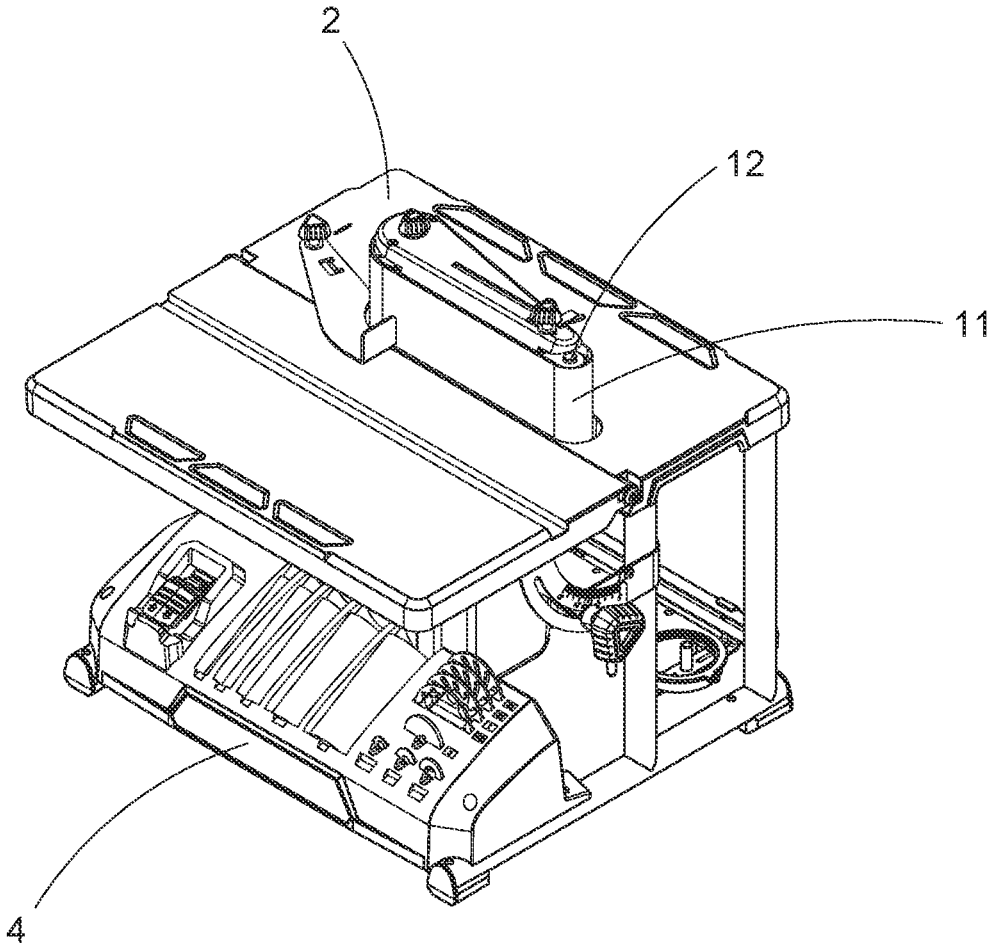
FIG. 1 is a perspective view of a belt sander incorporating an upward and downward motion mechanism according to the invention.
Figure 2:
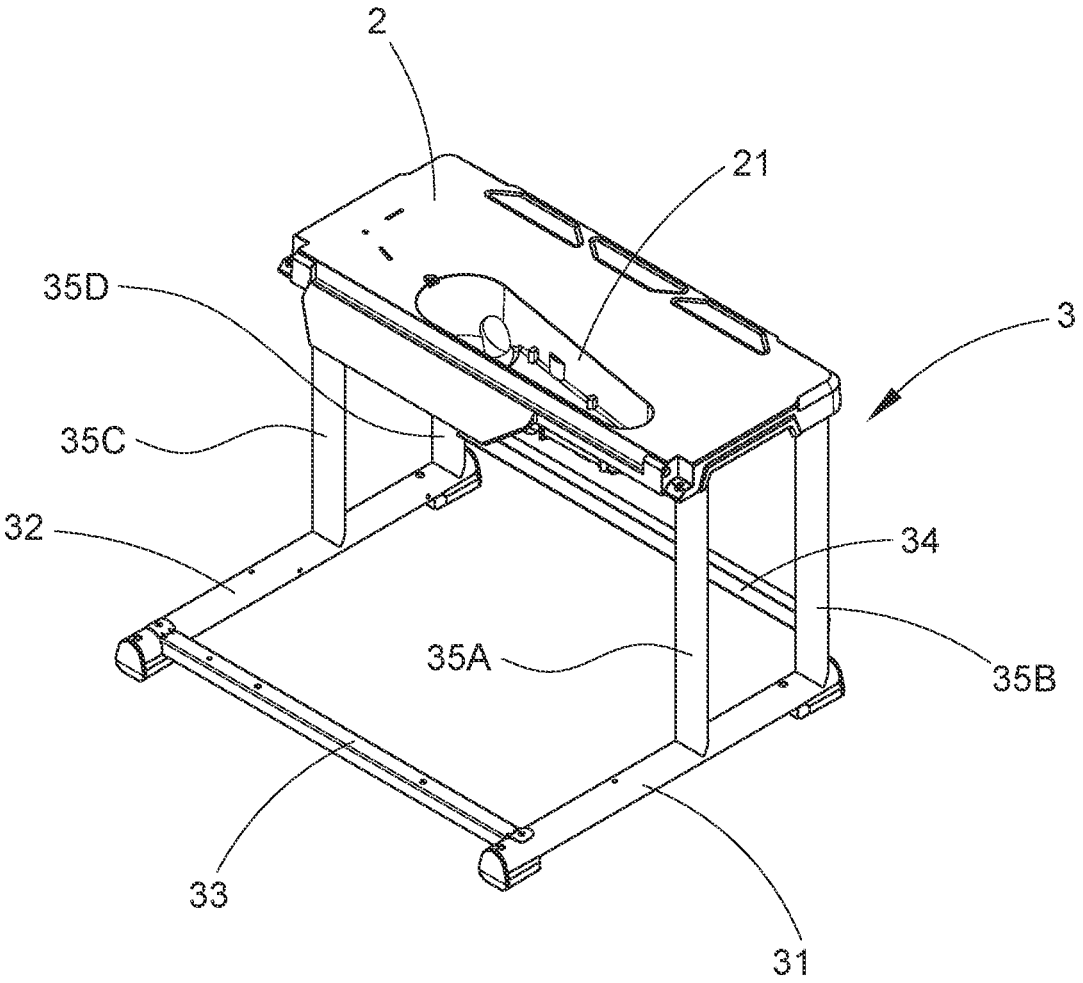
FIG. 2 is a perspective view of the worktable and the base.
Figure 3:
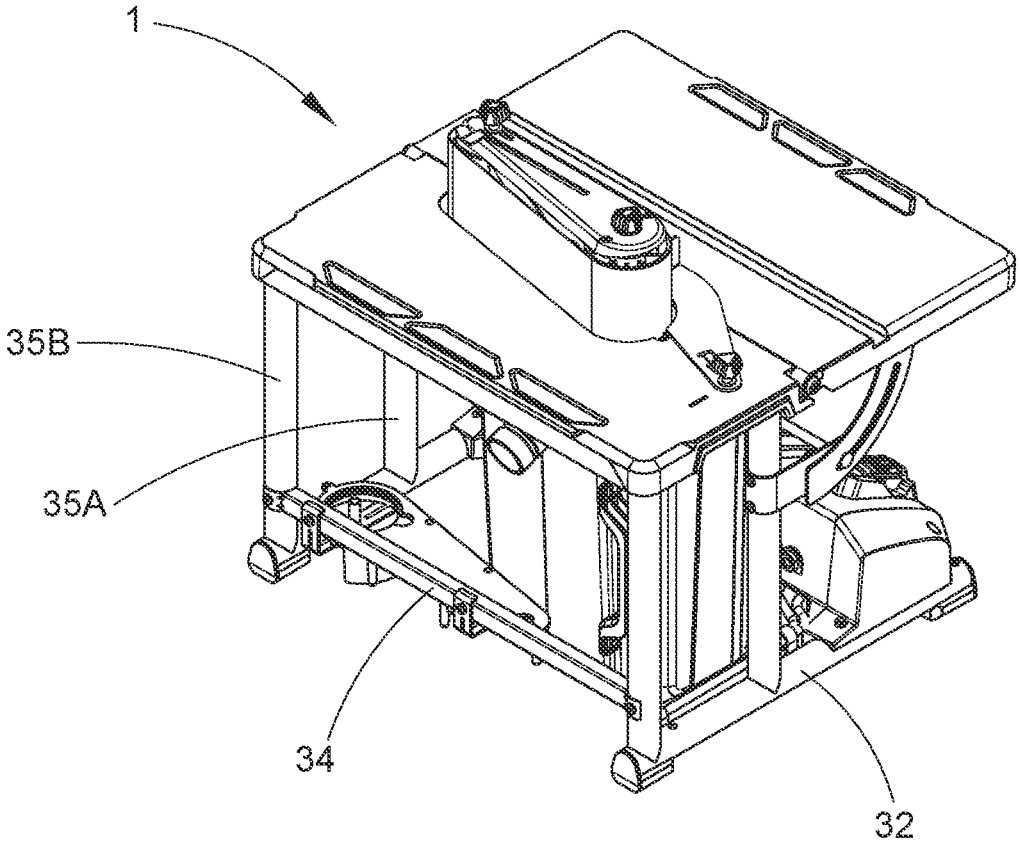
FIG. 3 is another perspective view of the belt sander.
Figure 4:
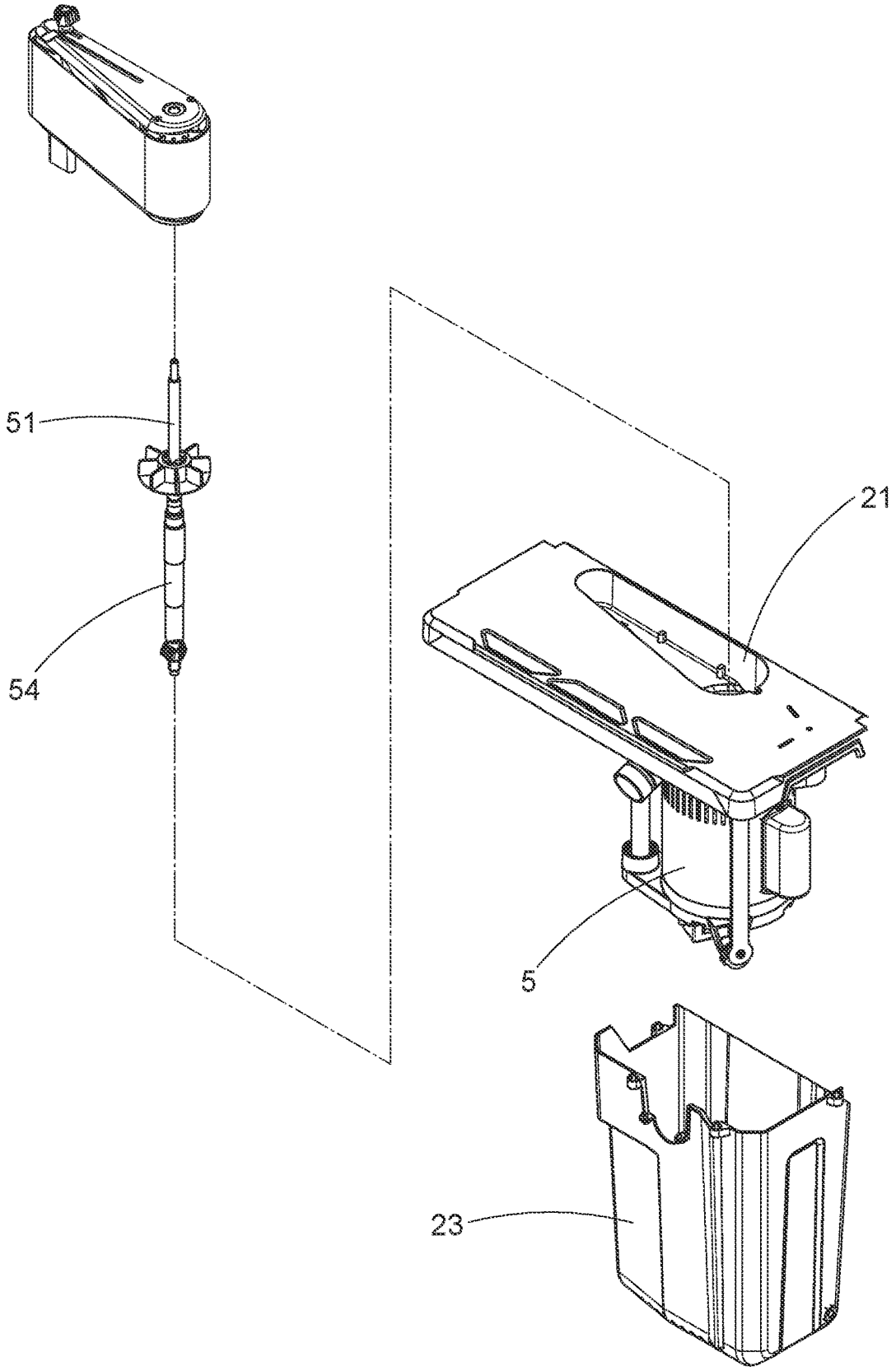
FIG. 4 is an exploded view of the upward and downward motion mechanism.
Figure 5:
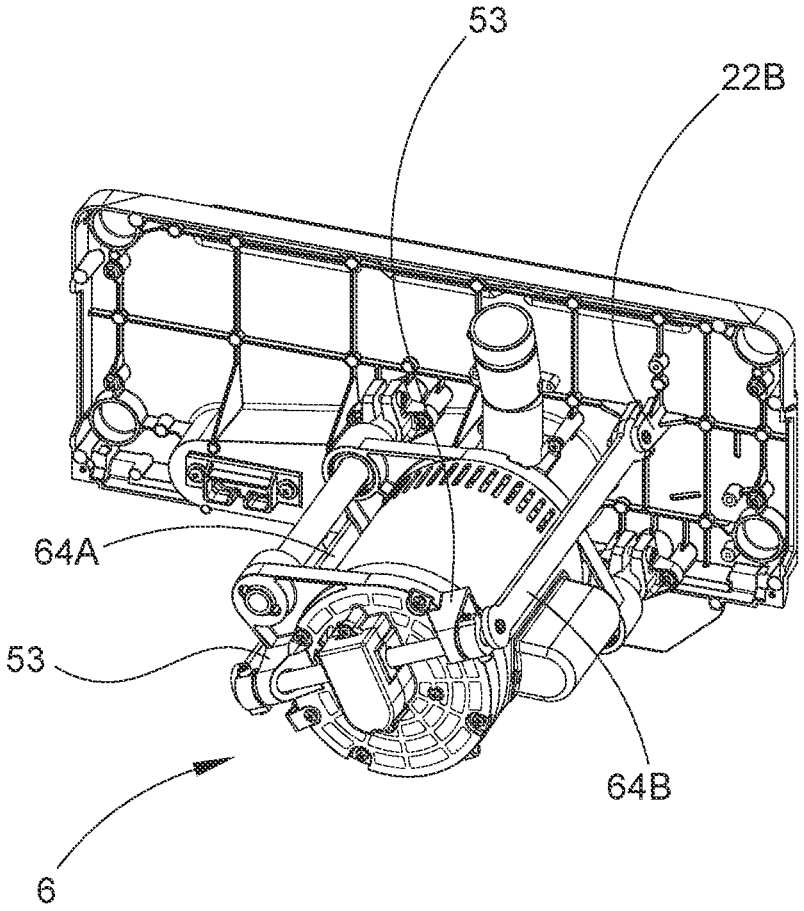
FIG. 5 is a bottom perspective view of the upward and downward motion mechanism with the housing removed.
Figure 6:
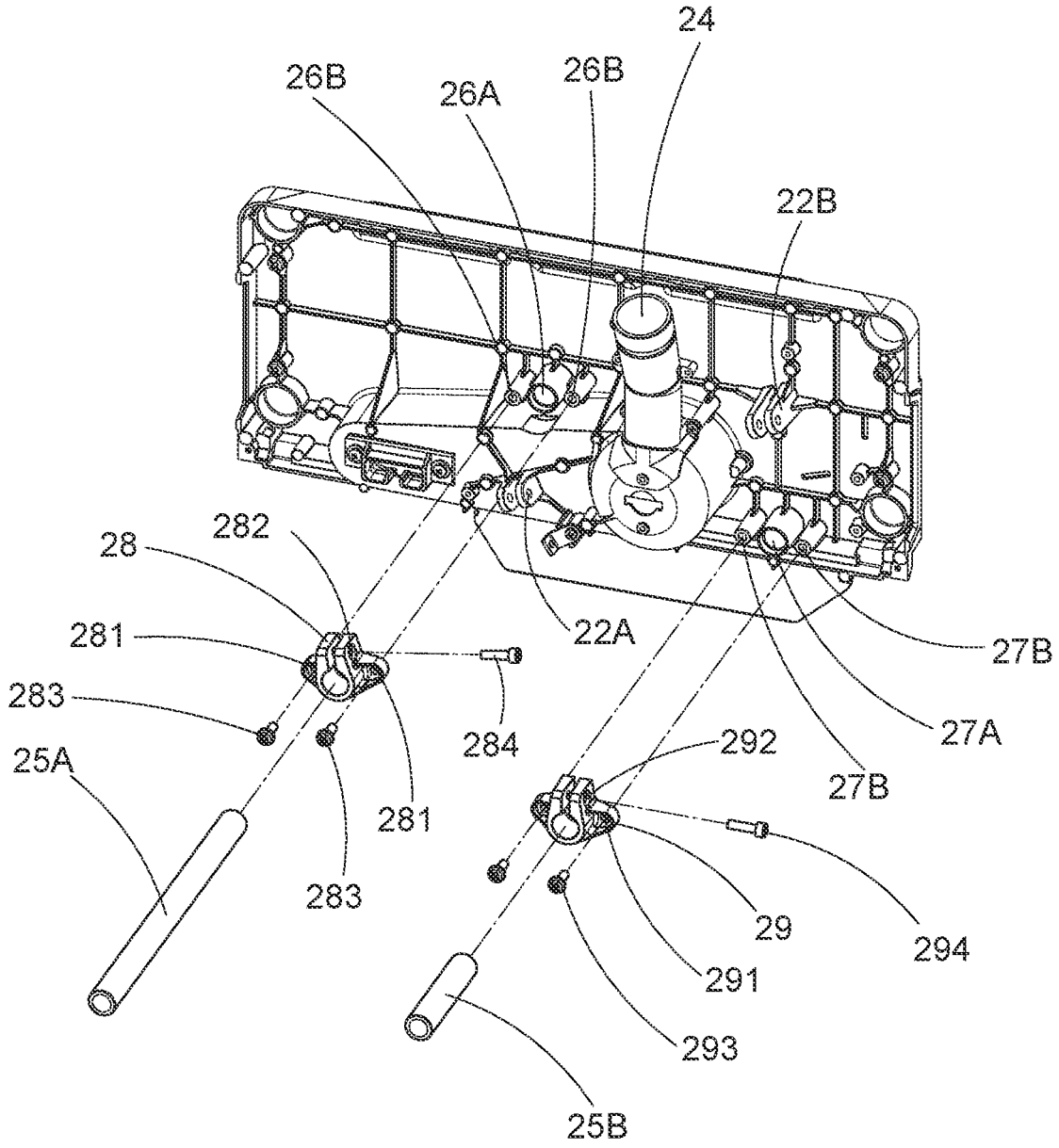
FIG. 6 is an exploded view of FIG. 5 with the electric motor and associated components removed.
Figure 7:
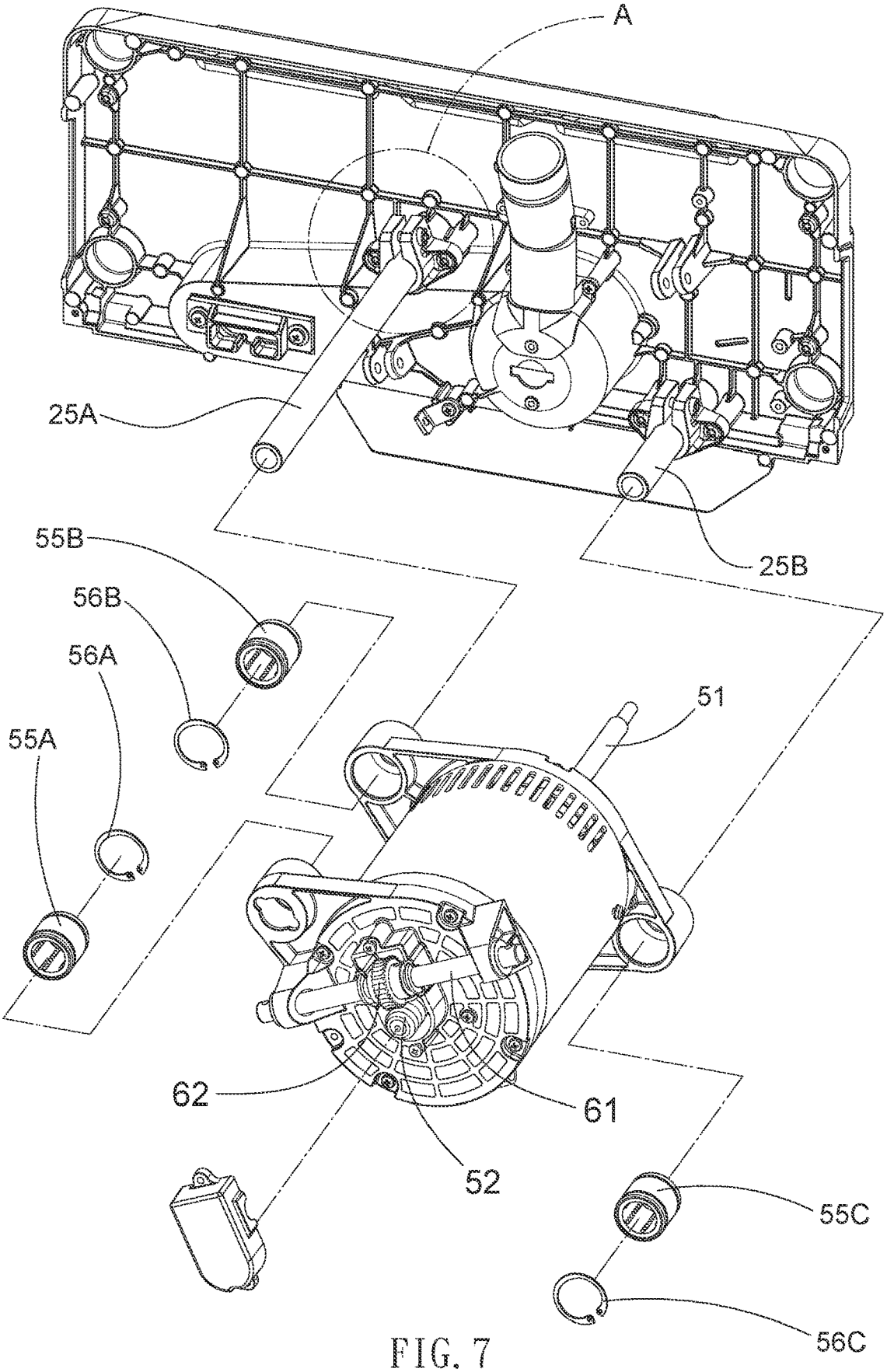
FIG. 7 is another exploded view of FIG. 5.
Figure 8:
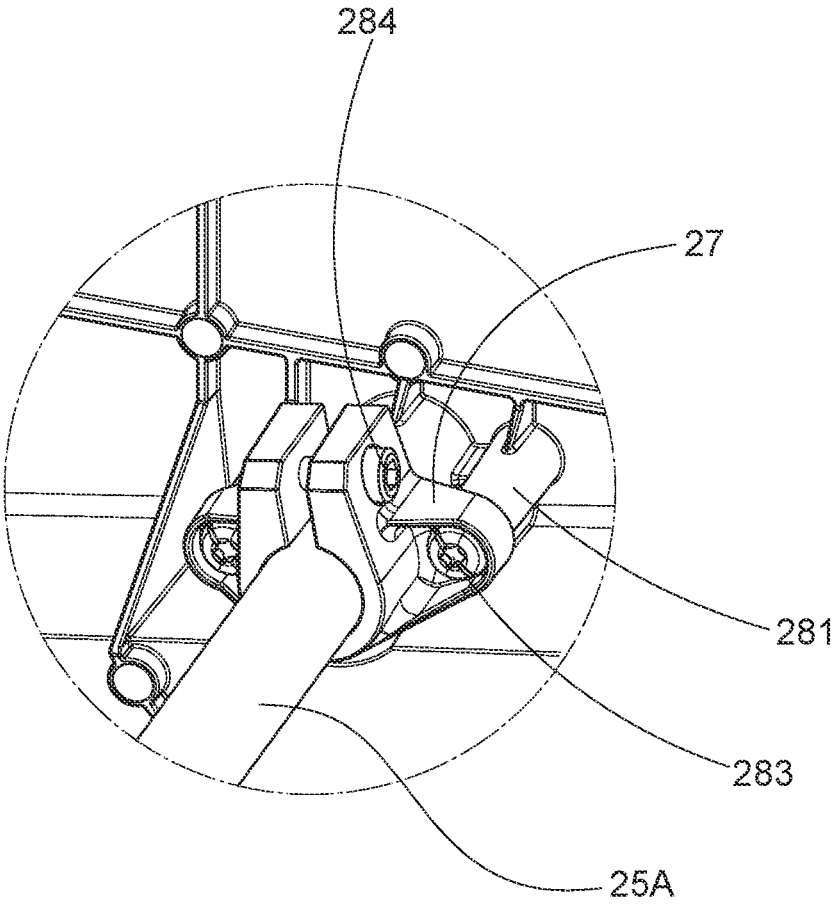
FIG. 8 is a detailed view of the area in a circle A of FIG. 7.
Figure 9:
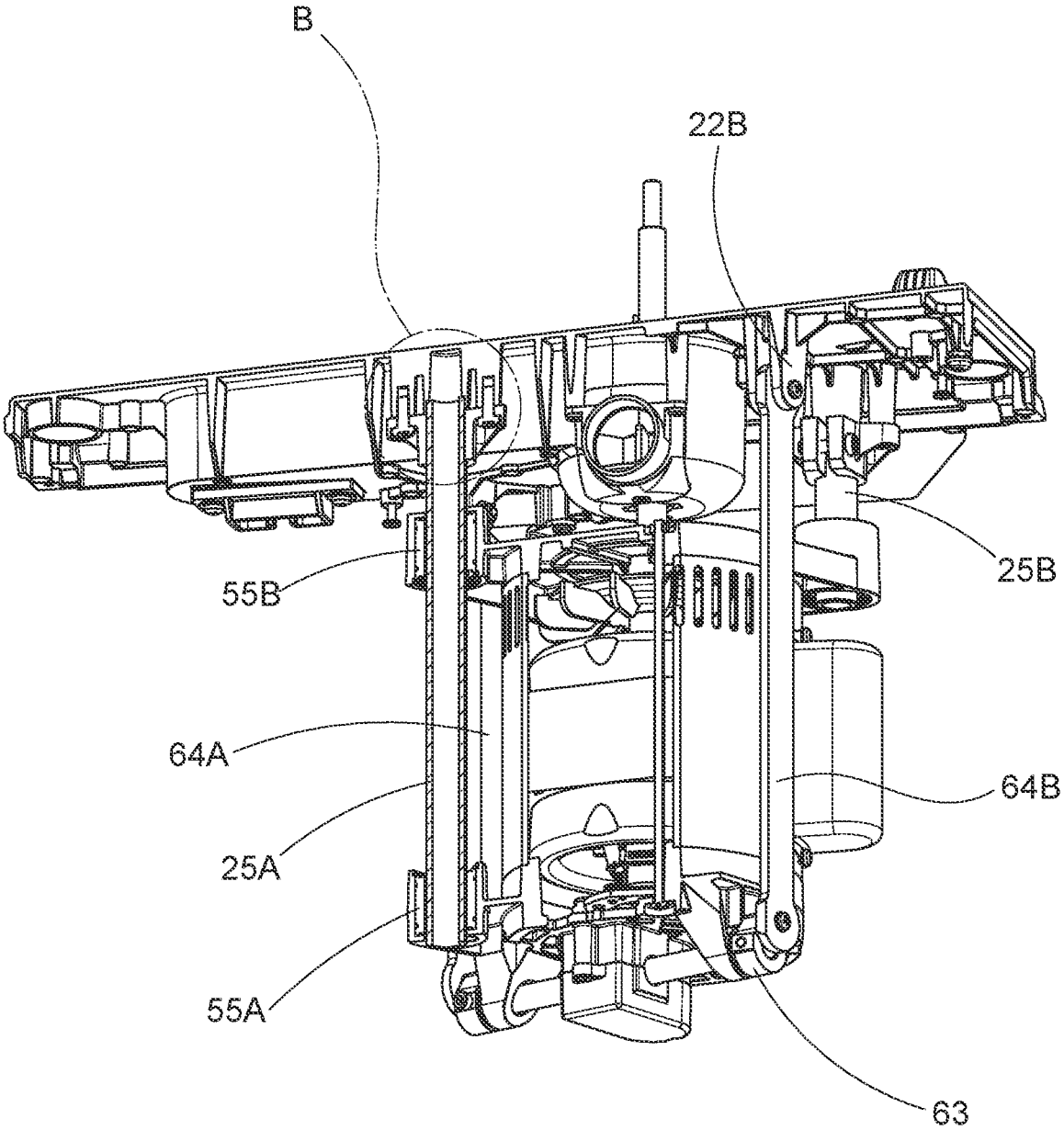
FIG. 9 is a side perspective view of the upward and downward motion mechanism with the housing removed.
Figure 10:
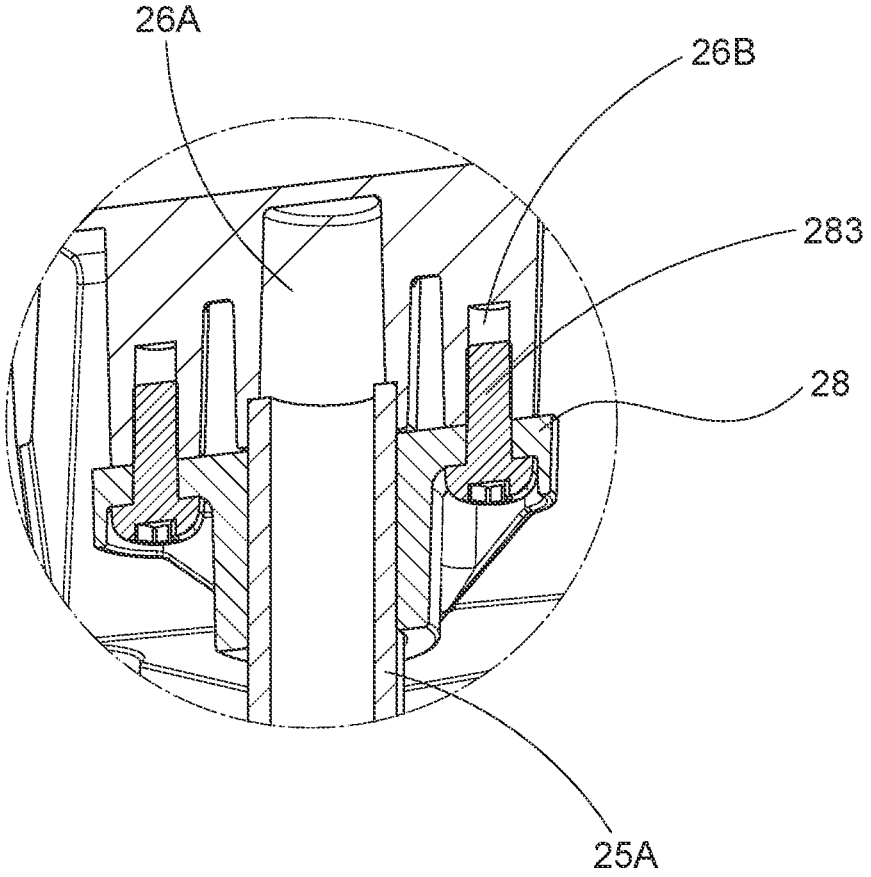
FIG. 10 is a detailed view of the area in a circle B of FIG. 9.
Figure 11:
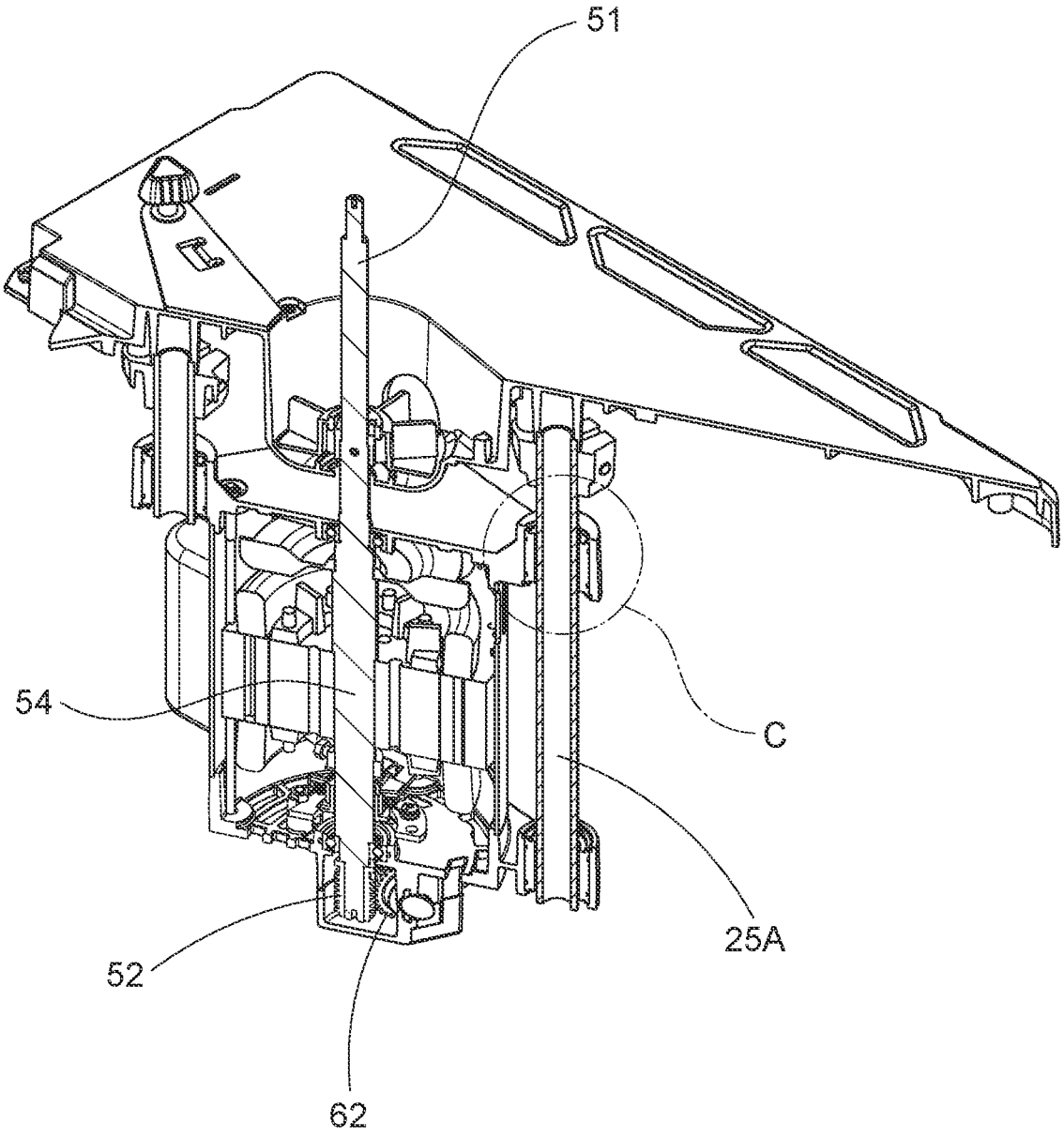
FIG. 11 is another perspective view of the upward and downward motion mechanism with the housing removed.
Figure 12:
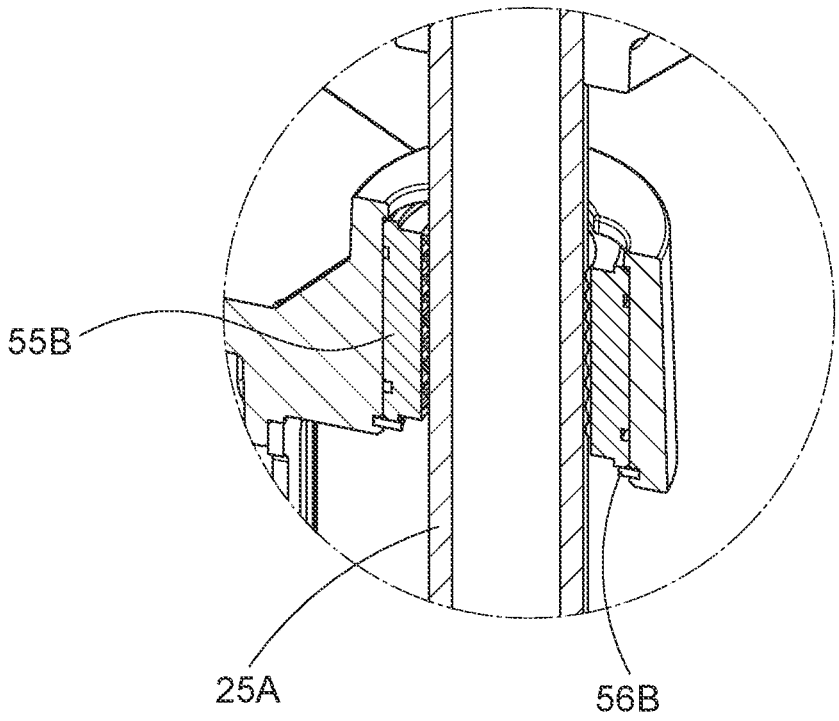
FIG. 12 is a detailed view of the area in a circle C of FIG. 11.
Figure 13:
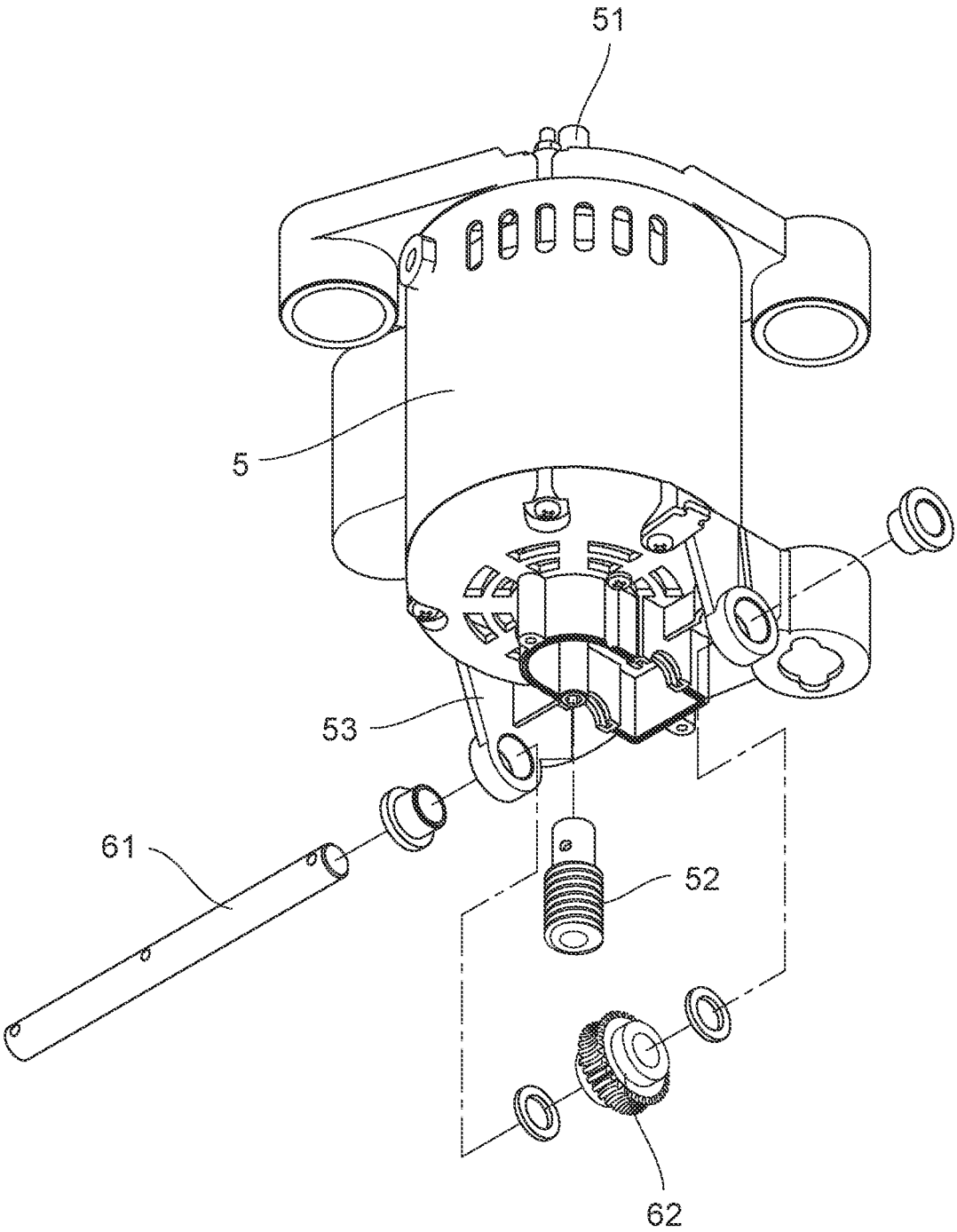
FIG. 13 is an exploded, perspective view of the transmitting assembly and the electric motor.
Figure 14:
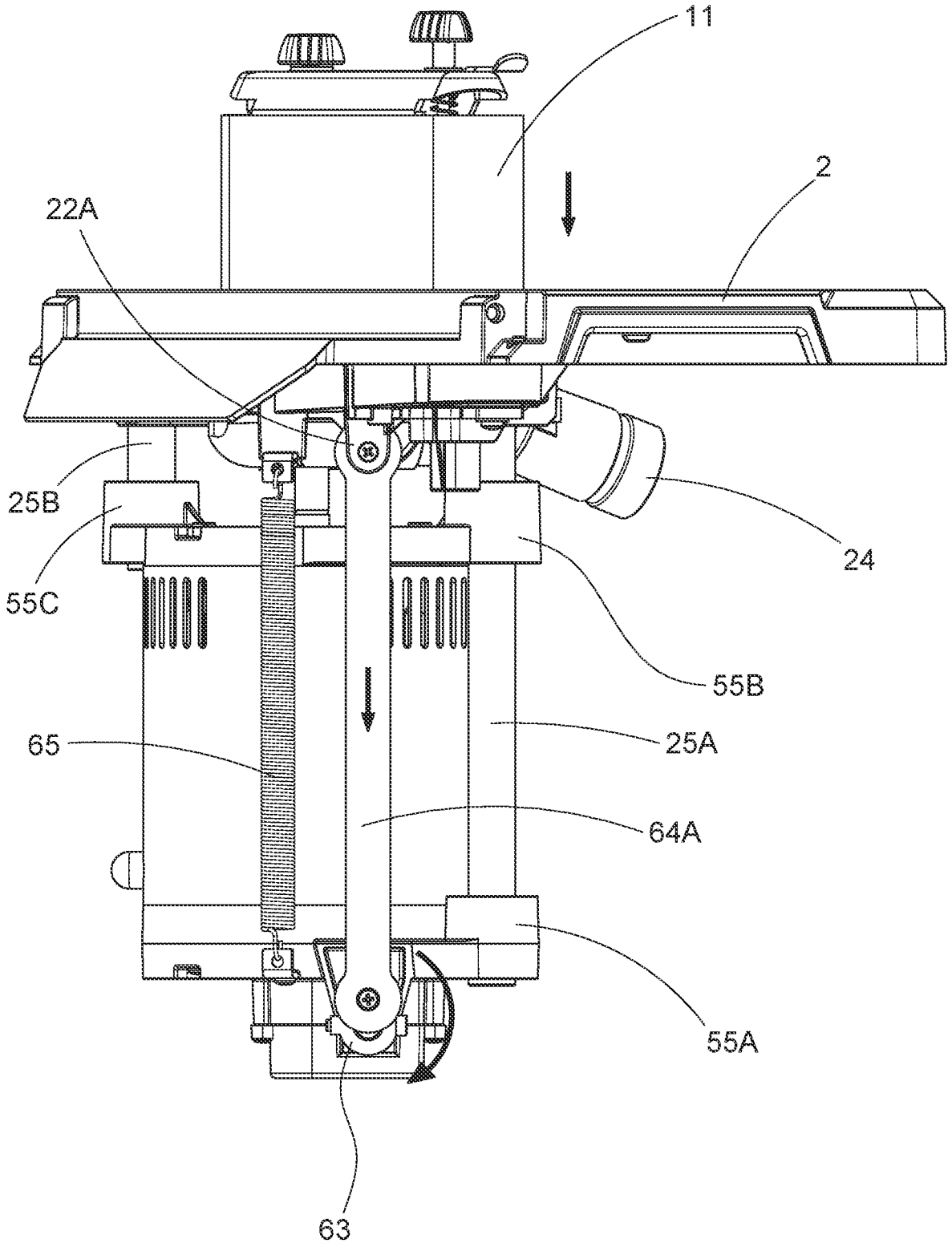
FIG. 14 is a side elevation schematically showing a downward motion of both the electric motor and the belt sander.
Figure 15:
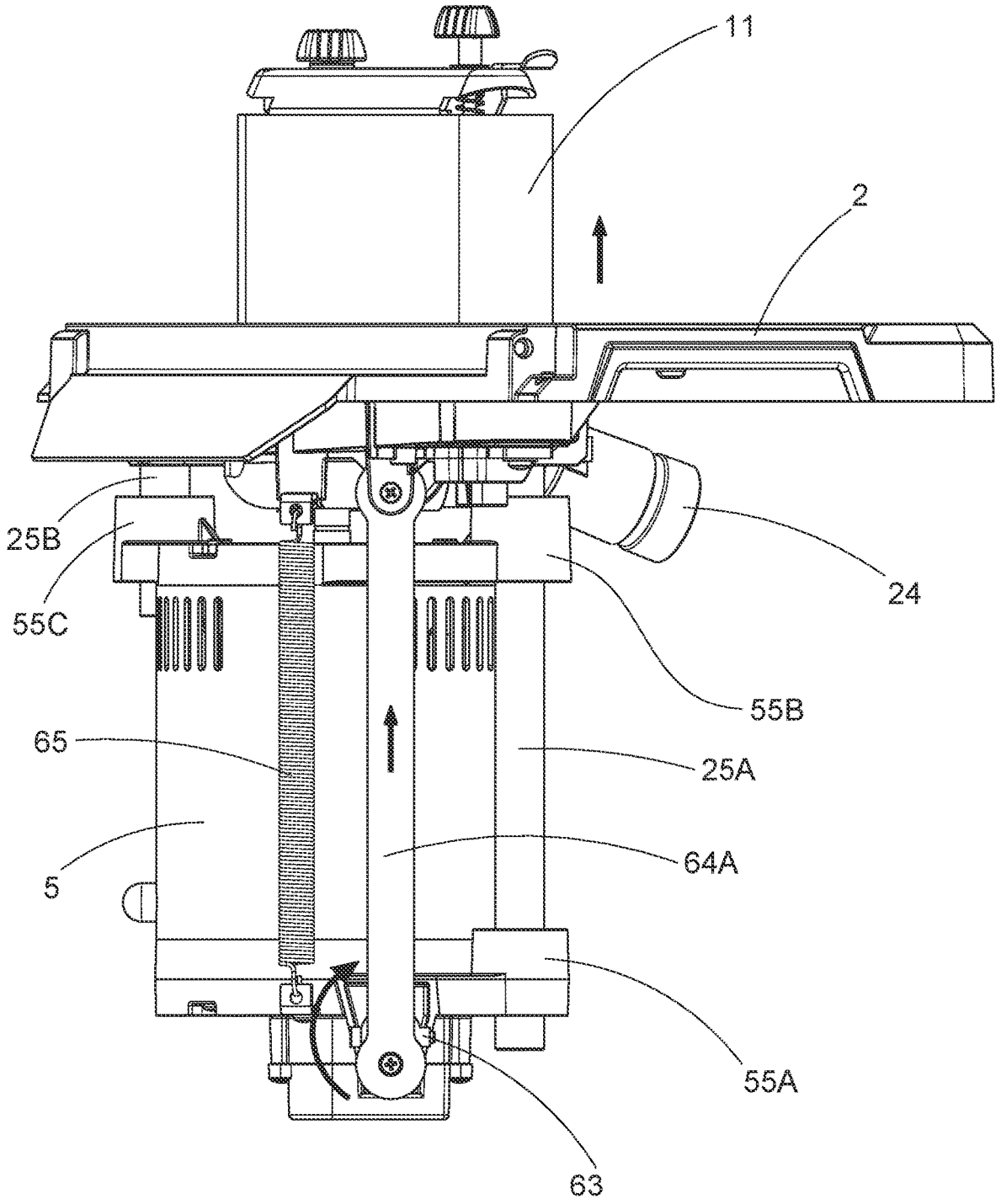
FIG. 15 is a view similar to FIG. 14 showing an upward motion of both the electric motor and the belt sander.

Referring to FIGS. 1 to 15, an upward and downward motion mechanism for a belt sander 1 in accordance with the invention is shown. The belt sander 1 includes a continuous loop of sandpaper 11 mounted on two end drums 12. The upward and downward motion mechanism includes the following components as discussed in detail below.

A detachable worktable 2 includes first and second sliding rods 25A, 25B; an opening 21 with the belt sander 1 upward and downward moveably disposed therethrough; first and second bifurcations 22A, 22B both on the underside; a housing 23 mounted to the underside with a portion of the opening 21 disposed thereabove; a chute 24 disposed under both one end drum 112 and the opening 21; a first bossed hole 26A on the underside of the worktable 2 with an upper end of the first sliding rod 25A disposed through; a second bossed hole 27A on the underside of the worktable 2 with an upper end of the second sliding rod 25B disposed through; two opposite third bossed holes 26B on the underside of the worktable 2 with the first bossed hole 26A disposed therebetween; two opposite fourth bossed holes 27B on the underside of the worktable 2 with the second bossed hole 27A disposed therebetween; a first C-shaped clamp 28 with the first sliding rod 25A passing through and having two opposite, longitudinal first holes 281, a transverse second threaded hole 282, two first screws 283 driven through the first holes 281 into the third bossed holes 26B to secure the first C-shaped clamp 28 to the underside of the worktable 2, and a second screw 284 driven through the second threaded hole 282 to adjustably secure the first C-shaped clamp 28 to the first sliding rod 25A; and a second C-shaped clamp 29 with the second sliding rod 25B passing through and having two opposite, longitudinal first holes 291, a transverse second threaded hole 292, two first screws 293 driven through the first holes 291 into the fourth bossed holes 27B to secure the second C-shaped clamp 29 to the underside of the worktable 2, and a second screw 294 driven through the second threaded hole 292 to adjustably secure the second C-shaped clamp 29 to the second sliding rod 25B.

A base assembly 3 includes a first horizontal brace 31, a second horizontal brace 32, a first horizontal interconnection 33 interconnecting front ends of the first and second horizontal braces 31 and 32, a second horizontal interconnection 34 interconnecting rear ends of the first and second horizontal braces 31 and 32, and first, second, third and fourth vertical posts 35A, 35B, 35C and 35D each releasably secured to the underside of the worktable 2 and the rear ends of the first and second horizontal braces 31, 32.

A control switch 4 is secured to the front ends of the first and second horizontal braces 31 and 32 and the first interconnection 33 for balancing the worktable 2.

An electric motor 5 is disposed in the housing 23 and includes an upper motor shaft 51 rotatably connected to one end drum 112 via an integral adapter 54; a lower worm screw 52; two legs 53; first, second and third ball bearings 55A, 55B and 55C in which a lower end of the first sliding rod 25A is slidably disposed through the first ball bearing 55A, an intermediate portion of the first sliding rod 25A is slidably disposed through the second ball bearing 55B, and the upper end of the first sliding rod 25A is slidably disposed through the first bossed hole 26A; and a lower end of the second sliding rod 25B is slidably disposed through the third ball bearing 55C and the upper end of the second sliding rod 25B is slidably disposed through the second bossed hole 27A; a first C-ring 56A for securing the first ball bearing 55A to the electric motor 5; a second C-ring 56B for securing the second ball bearing 55B to the electric motor 5; and a third C-ring 56C for securing the third ball bearing 55C to the electric motor 5. Both the motor shaft 51 and the worm screw 52 rotate at the speed as the electric motor 5 activates.

A transmitting assembly 6 is disposed in the housing 23 and includes a rotational shaft 61 rotatably disposed through the legs 53, a worm wheel 62 with the rotational shaft 61 disposed through and meshing with the worm screw 52 to transfer motion in 90-degree, two cams 63 secured to two ends of the rotational shaft 61 respectively, first and second links 64A, 64B with the electric motor 5 disposed therebetween in which the first link 64A has one end connected to one cam 63 and the other end connected to the first bifurcation 22A and the second link 64B has one end connected to the other cam 63 and the other end connected to the second bifurcation 22B; and a torsion spring 65 having one end anchored at an underside of the electric motor 5 and the other end anchored at the underside of the worktable 2.

In response to activating the electric motor 5, the motor shaft 51 rotates and in turn, one end drum 12 rotates. Thus, the continuous loop of sandpaper 11 shapes and finishes, for example wood. Generated sawdust is discharged to a collector (not shown) through the chute 24.

Operation of the invention is discussed below. The worm screw 52 rotates to rotate the worm wheel 62 which in turn rotates the cams 63. Further, the rotary motion of the worm wheel 62 is transformed into linear motion (i.e., repetitive upward and downward motion) of the first and links 64A, 64B due to the cams 63. Furthermore, the electric motor 5 repetitively moves upward and downward. And in turn, the first and second sliding rods 25A, 25B slide upward and downward with guiding of the first, second and second ball bearings 55A, 55B and 55C. As a result, the sandpaper 11 repetitively moves upward and downward.

The invention has the following advantages and benefits in comparison with the conventional art: the worktable 2 is more stable. Load of the continuous loop of sandpaper 11 is balanced and the useful life of the continuous loop of sandpaper 11 is prolonged. The torsion spring 65 can assist in the returning of the electric motor 5 to its original position after being lowered or lifted. The first, second and second ball bearings 55A, 55B and 55C can smooth the upward and downward movement. The first C-shaped clamp 28 ensures a sliding fastening of the first sliding rod 25A at the first bossed hole 26A, and the second C-shaped clamp 29 ensures a sliding fastening of the second sliding rod 25B at the second bossed hole 27A.

While the invention has been described in terms of preferred embodiments, those skilled in the art will recognize that the invention can be practiced with modifications within the spirit and scope of the appended claims.

What is claimed is:

1. A belt sander comprising:

a base assembly including a first horizontal brace, a second horizontal brace, a first horizontal interconnection interconnecting front ends of the first and second horizontal braces, a second horizontal interconnection interconnecting rear ends of the first and second horizontal braces, and first, second, third and fourth vertical posts each releasably secured to an underside of a worktable and the first, second, third and fourth vertical posts each releasably secured to rear ends of the first and second horizontal braces;

a control switch secured to the front ends of the first and second horizontal braces, and the first interconnection;

the worktable being detachable and including first and second sliding rods, an opening with the belt sander upward and downward moveably disposed therethrough, first and second bifurcations both on the underside, a housing mounted to the underside with a portion of the opening disposed thereabove; a chute disposed under both one end drum and the opening; a first bossed hole on the underside of the worktable with an upper end of a first sliding rod disposed through; a second bossed hole on the underside of the worktable with an upper end of a second sliding rod disposed through, two opposite third bossed holes on the underside of the worktable with the first bossed hole disposed therebetween, two opposite fourth bossed holes on the underside of the worktable with the second bossed hole disposed therebetween, a first C-shaped clamp with the first sliding rod passing through and having two opposite, longitudinal first holes, a transverse second threaded hole, two first screws driven through the first holes into the third bossed holes to secure the first C-shaped clamp to the underside of the worktable, and a second screw driven through the second threaded hole to adjustably secure the first C-shaped clamp to the first sliding rod, and a second C-shaped clamp with the second sliding rod passing through and the second C-shaped clamp also having two opposite, longitudinal first holes, a transverse second threaded hole, additional two first screws driven through the first holes into the fourth bossed holes to secure the second C-shaped clamp to the underside of the worktable, and an additional second screw driven through the second threaded hole to adjustably secure the second C-shaped clamp to the second sliding rod;

an electric motor disposed in the housing and including an upper motor shaft rotatably connected to one end drum via an integral adapter, a lower worm screw, two legs, first, second and third ball bearings wherein a lower end of the first sliding rod is slidably disposed through the first ball bearing, an intermediate portion of the first sliding rod is slidably disposed through the second ball bearing, and the upper end of the first sliding rod is slidably disposed through the first bossed hole, and a lower end of the second sliding rod is slidably disposed through the third ball bearing and the upper end of the second sliding rod is slidably disposed through the second bossed hole, a first C-ring for securing the first ball bearing to the electric motor, a second C-ring for securing the second ball bearing to the electric motor, and a third C-ring for securing the third ball bearing to the electric motor wherein both the motor shaft and the worm screw rotate at the speed as the electric motor activates; and a transmitting assembly disposed in the housing and including a rotational shaft rotatably disposed through the legs, a worm wheel with the rotational shaft disposed through and meshing with the worm screw to transfer motion in 90-degree, two cams secured to two ends of the rotational shaft respectively, first and second links with the electric motor disposed therebetween wherein the first link has one end connected to one cam and the other end connected to the first bifurcation and the second link has one end connected to the other cam and the other end connected to the second bifurcation, and a torsion spring having one end anchored at an underside of the electric motor and the other end anchored at the underside of the worktable.

* * * * *